US012332026B2

(12) United States Patent
Niklaus et al.

(10) Patent No.: US 12,332,026 B2
(45) Date of Patent: Jun. 17, 2025

(54) DEVICE DETERRING MOVEMENT OF A DETAINEE

(71) Applicant: Compliant Technologies, LLC, Nicholasville, KY (US)

(72) Inventors: Jeffery Niklaus, Nicholasville, KY (US); Zhiyong Jiang, Shenzhen (CN); Zhenyu Tan, XiangTan (CN)

(73) Assignee: COMPLIANT TECHNOLOGIES LLC, Nicholasville, KY (US)

( * ) Notice: Subject to any disclaimer, the term of this patent is extended or adjusted under 35 U.S.C. 154(b) by 16 days.

(21) Appl. No.: 18/507,060

(22) Filed: Nov. 12, 2023

(65) Prior Publication Data

US 2024/0085155 A1 Mar. 14, 2024

Related U.S. Application Data

(63) Continuation-in-part of application No. 17/565,961, filed on Dec. 30, 2021, which is a continuation-in-part of application No. 16/475,099, filed as application No. PCT/CN2017/095097 on Jul. 31, 2017, now abandoned.

(60) Provisional application No. 63/431,348, filed on Dec. 9, 2022.

(51) Int. Cl.

| | |
|---|---|
| ***F41H 13/00*** | (2006.01) |
| ***A41D 1/04*** | (2006.01) |
| ***A41D 19/00*** | (2006.01) |
| ***A41D 20/00*** | (2006.01) |

(52) U.S. Cl.

CPC ..... *F41H 13/0018* (2013.01); *A41D 1/04* (2013.01); *A41D 19/0024* (2013.01); *A41D 20/00* (2013.01); *F41H 13/0093* (2013.01); *A41D 2400/00* (2013.01); *A41D 2600/00* (2013.01)

(58) Field of Classification Search

CPC ... F41H 13/0018; F41H 13/0093; A41D 1/04; A41D 1/002; A41D 19/0024; A41D 20/00; A41D 2400/00; A41D 2600/00

USPC ..... 361/232

See application file for complete search history.

(56) References Cited

U.S. PATENT DOCUMENTS

| | | | | |
|---|---|---|---|---|
| 4,943,885 A * | 7/1990 | Willoughby | ..... | F41H 13/0018 361/232 |
| 5,193,048 A | 3/1993 | Kaufman et al. | | |
| 5,677,676 A | 10/1997 | Bell, Jr. | | |
| 6,272,781 B1 | 8/2001 | Resnick | | |
| 7,012,797 B1 * | 3/2006 | Delida | ..... | F41H 13/0018 361/232 |

(Continued)

FOREIGN PATENT DOCUMENTS

| | | | |
|---|---|---|---|
| CN | 2358706 Y | | 1/2000 |
| CN | 102778173 A | * | 11/2012 |
| CN | 105146813 A | | 12/2015 |

OTHER PUBLICATIONS

Machine translation of Jiang et al. Chinese Patent Document CN 102778173 A Nov. 2012 (Year: 2012).*

*Primary Examiner* — Kevin J Comber

(74) *Attorney, Agent, or Firm* — BUSINESS PATENT LAW, PLLC

(57) ABSTRACT

A device for deterring movement of a detainee adapted to dispense pulsed electric current to a human's epidermis and dermis. The pulsed electric current can interfere temporarily with muscular locomotion of the detainee. Embodiments of the device for deterring movement of a detainee include, but are limited to bands, gloves and vests.

20 Claims, 7 Drawing Sheets

(56) References Cited

U.S. PATENT DOCUMENTS

| | | | | |
|---|---|---|---|---|
| 7,284,280 | B2 | 10/2007 | Schultz | |
| 7,580,237 | B2 | 8/2009 | Nerheim | |
| 8,866,869 | B2 | 10/2014 | Fennell | |
| 9,042,077 | B2 | 5/2015 | Jones et al. | |
| 9,086,256 | B2 | 6/2015 | Schweitzer | |
| 9,182,193 | B1 | 11/2015 | Nerheim | |
| 10,401,130 | B2 | 9/2019 | Pasley et al. | |
| 11,073,365 | B2 | 7/2021 | Gullotti | |
| 11,118,872 | B2 | 9/2021 | Goodchild et al. | |
| 11,236,973 | B2 | 2/2022 | D'oriano | |
| 11,380,212 | B2 | 7/2022 | Quail et al. | |
| 2003/0137795 | A1* | 7/2003 | Buening | H05C 1/06 361/253 |
| 2004/0264099 | A1 | 12/2004 | Sikes | |
| 2005/0115387 | A1* | 6/2005 | Smith | H05C 1/06 89/1.11 |
| 2007/0183115 | A1 | 8/2007 | Myers | |
| 2011/0002077 | A1 | 1/2011 | Brundula et al. | |
| 2016/0216083 | A1 | 7/2016 | Russomanno | |
| 2019/0216146 | A1* | 7/2019 | Yang | D05C 1/06 |
| 2019/0331464 | A1 | 10/2019 | Jiang et al. | |
| 2020/0401229 | A1 | 12/2020 | Dugo | |
| 2021/0010786 | A1 | 1/2021 | Gullotti | |
| 2021/0172714 | A1 | 6/2021 | D'oriano | |
| 2023/0152064 | A1 | 5/2023 | Torroella | |

* cited by examiner

DEVICE DETERRING MOVEMENT OF A DETAINEE

PRIORITY

Applicant and this application claim the benefit of U.S. Provisional Patent Application 63/431,348—Restraint for a Detainee—, filed Dec. 9, 2022; and Applicant and this application claim priority to pending U.S. application Ser. No. 17/565,961—Glove Adapted to Dispense Pulsed Electric Current to a Human's Skin—, filed Dec. 30, 2021, Jiang, Z, that claims priority to U.S. application Ser. No. 16/475,099—Catching Glove Management System and Supervision Method—, filed Jun. 30, 2019, Jiang, Z, that claimed priority to PCT Chinese Application PCT/CN2017/095097—Catching Glove Management System and Supervision Method—filed Jul. 31, 2017.

BACKGROUND OF THE INVENTION

A. Field of the Invention

The present device for deterring movement of a detainee can dispense pulsed electric current to a human's epidermis and dermis. Among other things, the dispensed pulsed electric current can induce neuro-peripheral interference that temporarily interferes with muscular locomotion of the human.

B. Description of the Previous Art

Any discussion of references cited in this Description of the Previous Art merely summarizes the disclosures of the cited references and Applicant makes no admission that any cited reference or portion thereof is relevant prior art. Applicant reserves the right to challenge the accuracy, relevancy and veracity of the cited references.

References that may indicate a state-of-the-art for the current invention include: 1) EnglishTransliterationCN2358706Y, 2) EnglishTransliterationCN102778173A, 3) EnglishTransliterationCN105146813A, 4) US20190331464A1—JIANG et al., 5) U.S. Ser. No. 11/236,973—D'oriano, 6) US20160216083A1—Russomanno, 7) U.S. Pat. No. 9,086,256B2—Schweitzer, 8) US20230152064A1—Torroella, 9) US20210010786A1—Gullotti, 10) U.S. Ser. No. 11/073,365B2—Gullotti, 11) U.S. Pat. No. 9,042,077B2—Jones et al, 12) US20210172714A1—D'oriano, 13) US20040264099A1—Sikes, 14) U.S. Ser. No. 10/401,130B2—Pasley et al, 15) U.S. Pat. No. 7,284,280B2—Schultz, 16) U.S. Pat. No. 6,272,781—Resnick, 17) U.S. Ser. No. 11/380,212B2—Quail et al, 28) US20200401229A1—Dugo, 19) US20070183115A1—Myers, 20) U.S. Pat. No. 4,943,885—Willoughby, 21) U.S. Pat. No. 5,677,676—Bell Jr., 22) U.S. Pat. No. 8,866,869B2—Fennell, 23) U.S. Pat. No. 7,580,237B2—Nerheim, 24) U.S. Pat. No. 9,182,193B1—Nerheim, 25) U.S. Ser. No. 11/118,872B2—Goodchild et al, 26) US20110002077A1—Brundula et al, 27) U.S. Pat. No. 5,193,048—Kaufman et al, and 28) U.S. Pat. No. 7,012,797B1—Delida.

Among other things, none of the above listed references disclose a device deterring movement of a detainee comprising: a) a microprocessor embedded into a reusable, cleanable and conductive fabric; the microprocessor comprising a transceiver component; b) a memory in communication with the microprocessor; the memory holding software component controlling operations of the device deterring movement of the detainee and data about operations of the device deterring movement of the detainee, wherein the software component and the microprocessor control the application of an electric shock to a portion of exposed epidermis of the detainee by causing one of the at least two electrodes, embedded in the reusable, cleanable and conductive fabric, to administer a nonlethal electric shock to the detainee, wherein the nonlethal electric shock: i) travels only through the detainee's epidermis and dermis; ii) is administered in ranges from about 210-380 volts, 0.5-1.5 amperes, charge levels of 84-125 microcoulombs and pulse durations between 105-115 microseconds; and iii) interferes temporarily with muscular locomotion of the detainee; c) a rechargeable battery embedded into to the reusable, cleanable and conductive fabric; and d) circuitry interconnecting the transceiver component, the microprocessor, the memory, the rechargeable battery and the at least two electrodes.

SUMMARY OF THE INVENTION

Except for application Ser. No. 17/565,961—Glove Adapted to Dispense Pulsed Electric Current to a Human's Skin—to which priority is claimed, it is believed there is no other device deterring movement of a detainee that generates a neuro-peripheral interference in the section of the epidermis and dermis receiving the pulsed electric current. It has been discovered that the nonlethal shock travels only through the detainee's epidermis and dermis and interferes temporarily with muscular locomotion of the detainee.

An aspect of the present devices is the inducement of neuro-peripheral interference in the epidermis and dermis of the detainee.

Still another aspect of the present devices is to provide an arc free electrical shock to the detainee not resulting in damage to the epidermis or dermis.

Yet still another aspect of the present devices is to provide devices that can be worn by the detainee or by the operator.

Another aspect of the present devices is to provide devices manufactured from electrically conductive reusable, cleanable and conductive fabrics.

Still another aspect of the present devices is to provide devices where electric current fails to penetrate a layer of the detainee's clothing.

Yet still another aspect of the present devices is to provide devices including a cut, slash, puncture and fire-resistant outer layer.

Another aspect of the present devices is to provide devices that can be activated buy a manual switch or a radio frequency switch.

Still another aspect of the present devices is to provide haptic capabilities incorporated into the devices.

Yet still another aspect of the present devices is to provide an epidermal sensor.

Another aspect of the present devices is to provide devices capable of pairing with operating systems distinct from the present devices' memories and microprocessors.

Still another aspect of the present devices is to manufacture the devices with fabrics, where the fabrics are capable of activating/deactivating touch sensitive equipment, such as, computing devices including touch sensitive controls.

Yet still another aspect of the present devices is to allow an operator to switch the microprocessor to operational in about one second and to a standby or off mode in about three seconds.

A preferred embodiment of the current invention can be described as a device deterring movement of a detainee comprising: a) a microprocessor embedded into a reusable, cleanable and conductive fabric; the microprocessor comprising a transceiver component; b) a memory in communication with the microprocessor; the memory holding software controlling operations of the device deterring movement of the detainee and data about activation/deactivation of the device deterring movement of the detainee, wherein the software and the microprocessor are adapted to: i) pair the microprocessor and memory with an operator's video camera such that an event can be recorded; and/or ii) coordinate a global positioning system tracking with the device deterring movement of a detainee; and iii) control an electric shock to a portion of exposed skin of the detainee by causing one of the at least two electrodes, embedded in the reusable, cleanable and conductive fabric, to administer a nonlethal electric shock to the detainee, wherein the nonlethal electric shock: travels only through the detainee's epidermis and dermis; is administered in ranges from about 210-380 volts, 0.5-1.5 amperes, charge levels of 84-125 microcoulombs and pulse durations between 105-115 microseconds; and interferes temporarily with muscular locomotion of the detainee; c) a rechargeable battery embedded into to the reusable, cleanable and conductive fabric; and d) circuitry interconnecting the transceiver component, the microprocessor, the memory, the rechargeable battery and the at least two electrodes.

Another preferred embodiment of the current invention can be described as a device deterring movement of a detainee comprising: a) a microprocessor embedded into a reusable, cleanable and conductive fabric; the microprocessor comprising a transceiver component; b) a memory in communication with the microprocessor; the memory holding software component controlling operations of the device deterring movement of the detainee and data about operations of the device deterring movement of the detainee, wherein the software component and the microprocessor control the application of an electric shock to a portion of exposed epidermis of the detainee by causing one of the at least two electrodes, embedded in the reusable, cleanable and conductive fabric, to administer a nonlethal electric shock to the detainee, wherein the nonlethal electric shock: i) travels only through the detainee's epidermis and dermis; ii) is administered in ranges from about 210-380 volts, 0.5-1.5 amperes, charge levels of 84-125 microcoulombs and pulse durations between 105-115 microseconds; and iii) interferes temporarily with muscular locomotion of the detainee; c) a rechargeable battery embedded into to the reusable, cleanable and conductive fabric; and d) circuitry interconnecting the transceiver component, the microprocessor, the memory, the rechargeable battery and the at least two electrodes.

It is the novel and unique interaction of these simple elements which creates the apparatus and methods, within the ambit of the present invention. Pursuant to Title 35 of the United States Code, descriptions of preferred embodiments follow. However, it is to be understood that the best mode descriptions do not limit the scope of the present invention.

BRIEF DESCRIPTION OF THE DRAWINGS

FIGS. 6*a* & 6*b* are perspectives of a plurality of posterior sides of vests (260*a*, 260*b*) and a corresponding plurality of transmitters (400*a*, 400*b*) of the device deterring movement of a detainee (100).

DESCRIPTION OF THE PREFERRED EMBODIMENTS

Figure 1:
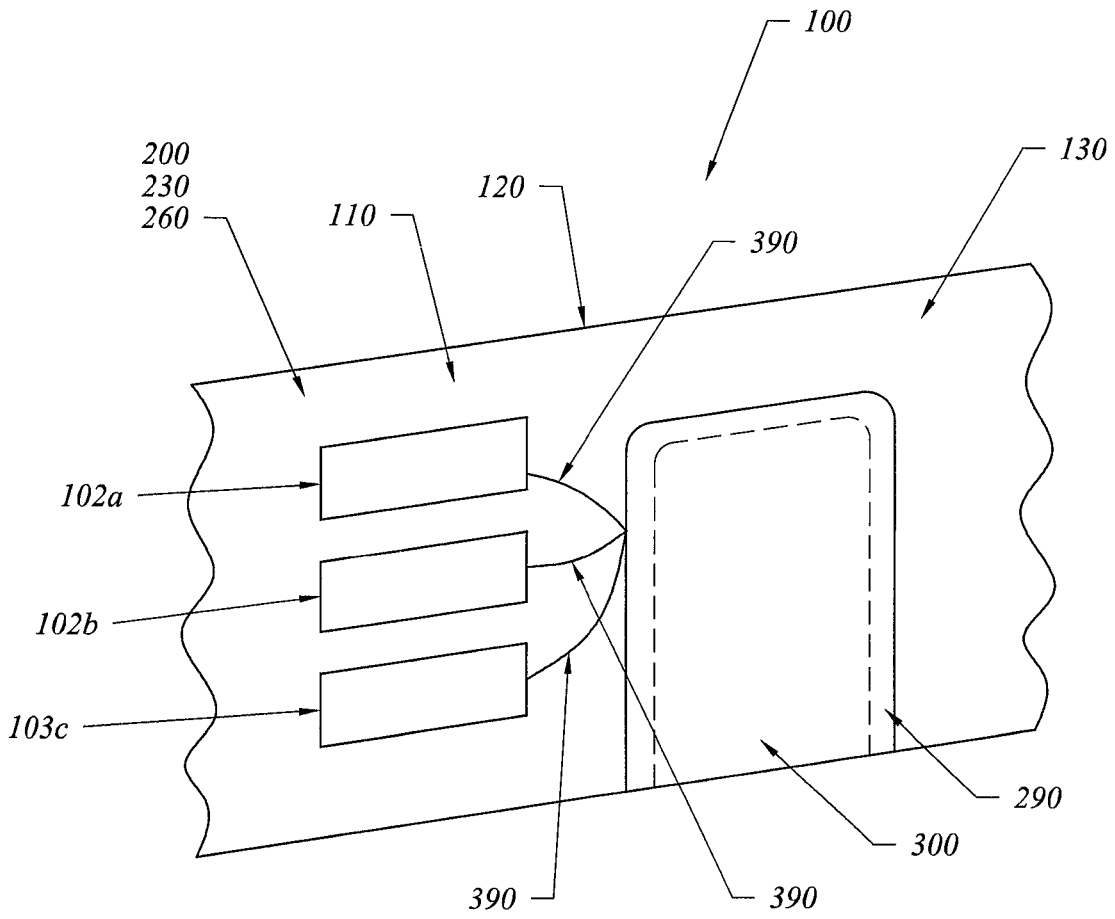
FIG. 1 is a portion of a garment (200, 230, 260) including electrodes (102*a*, 102*b*, 102*c*), pocket (290) for containing single piece housing (300) of the device deterring movement of a detainee (100).
Figure 2:
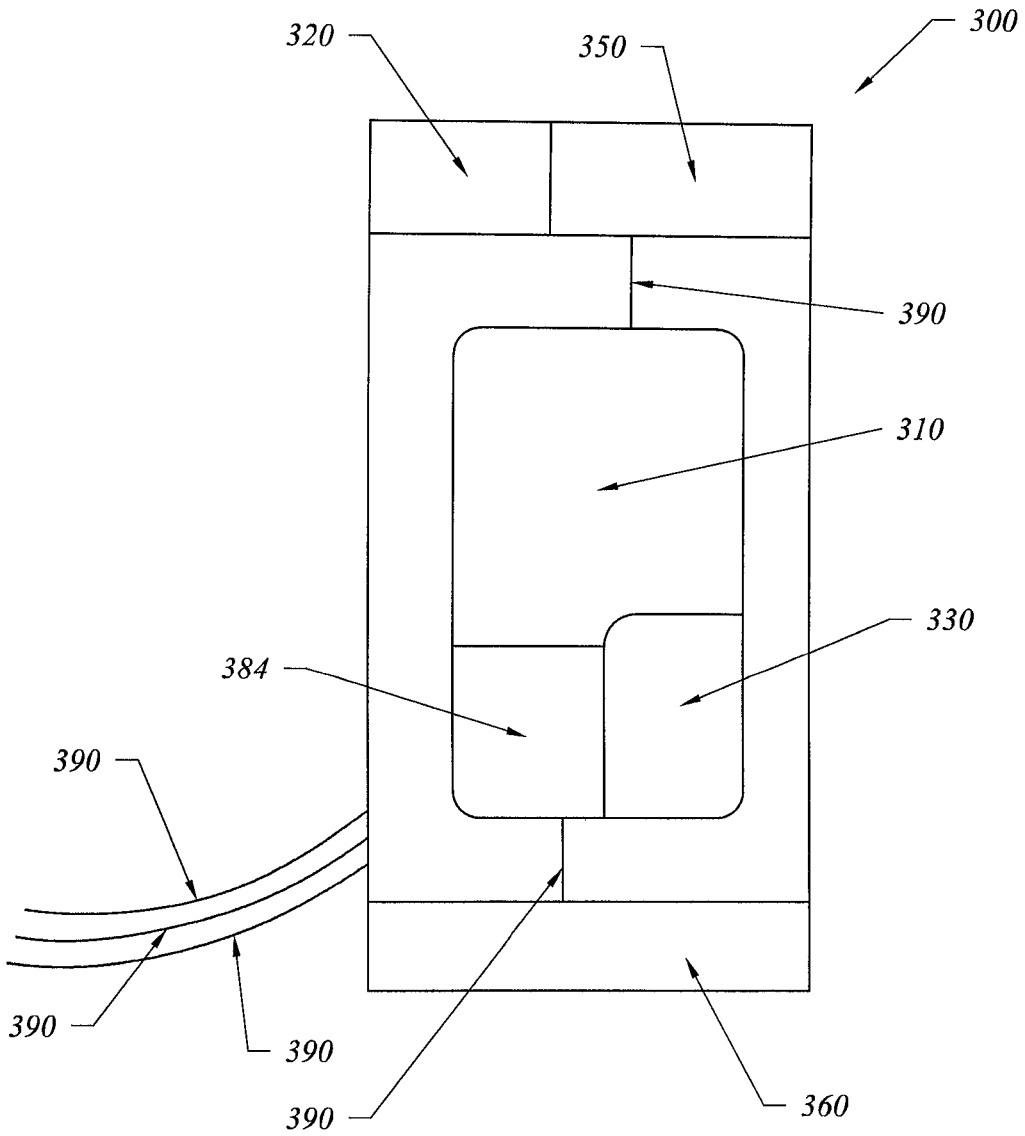
FIG. 2 is a depiction of a first embodiment of single piece housing (300) including microprocessor (310), memory (320) and other components associated with single piece housing (300) of the device deterring movement of a detainee (100).
Figure 3:
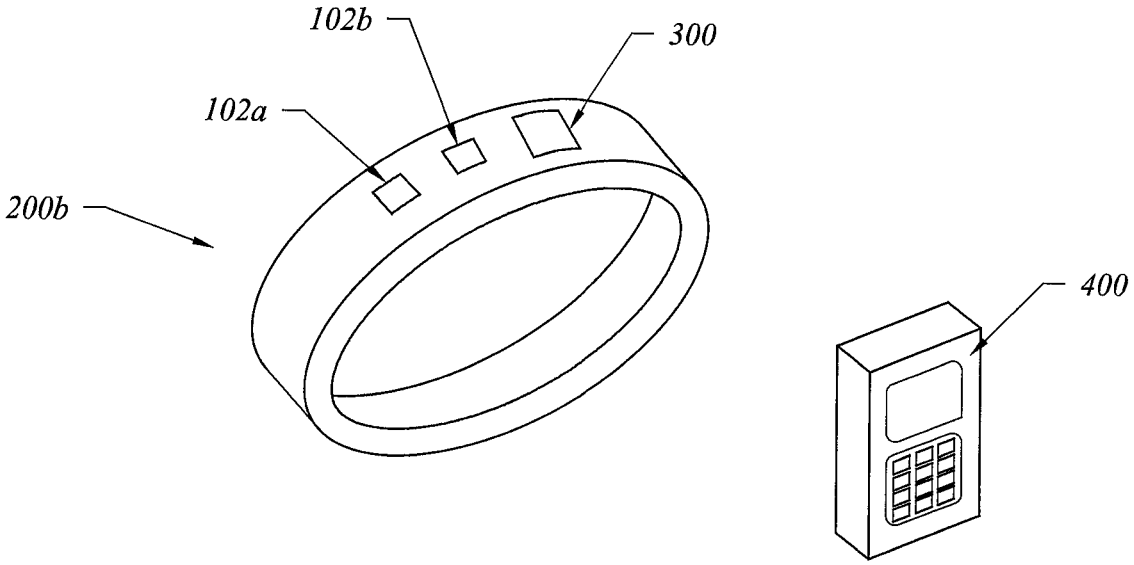
FIG. 3 is a perspective of band (200) and transmitter (400) of the device deterring movement of a detainee (100).
Figure 4:
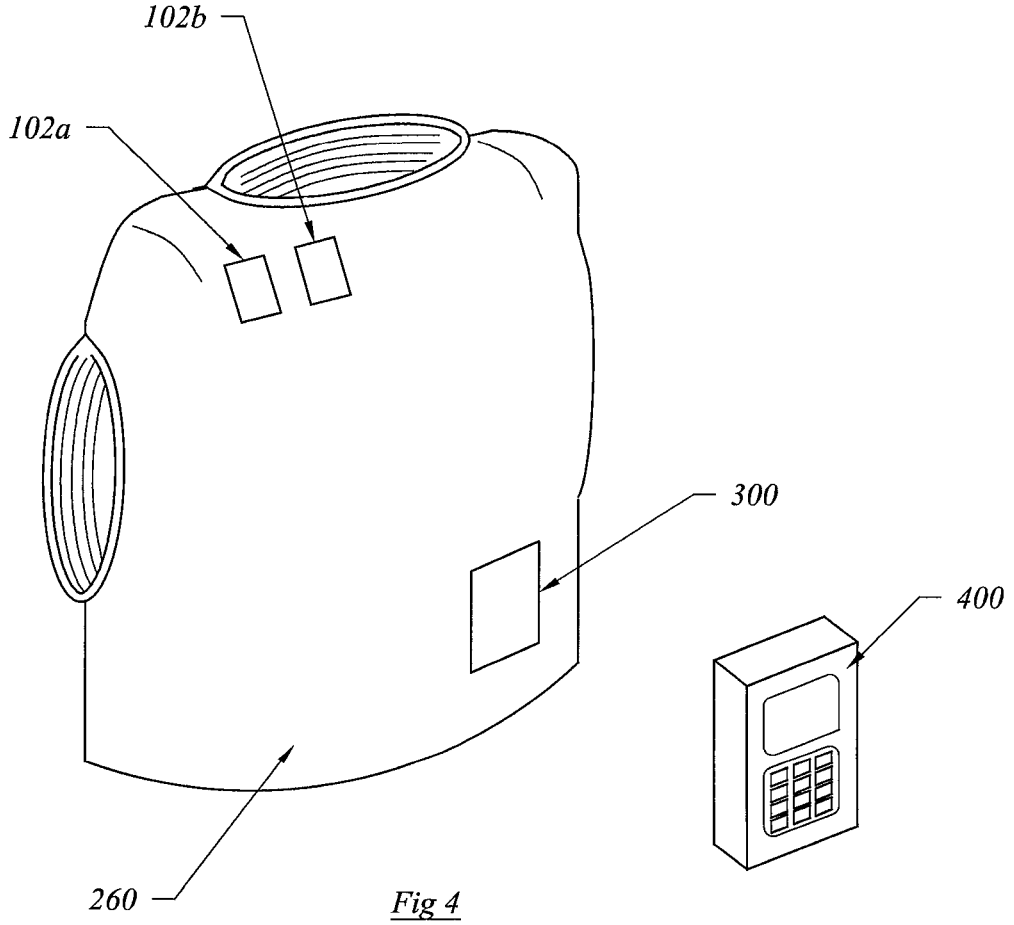
FIG. 4 is a perspective of posterior side of vest (260) and transmitter (400) of the device deterring movement of a detainee (100).
Figure 5:
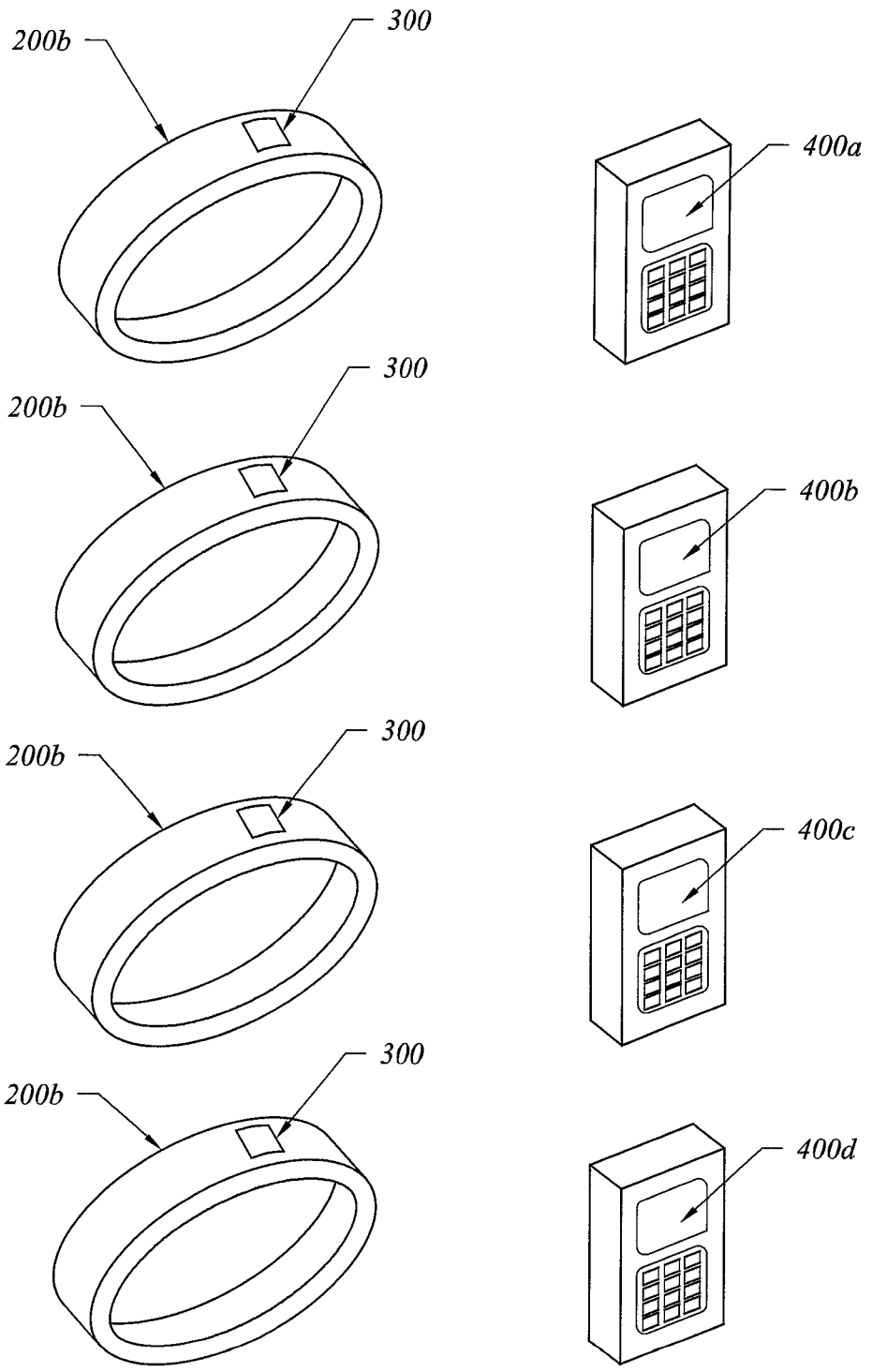
FIG. 5 is a perspective of a plurality of bands (200*a*, 200*b*, 200*c*, 200*d*) and a corresponding plurality of transmitters (400*a*, 400*b*, 400*c*, 400*d*) of the device deterring movement of a detainee (100).
Figure 6B:
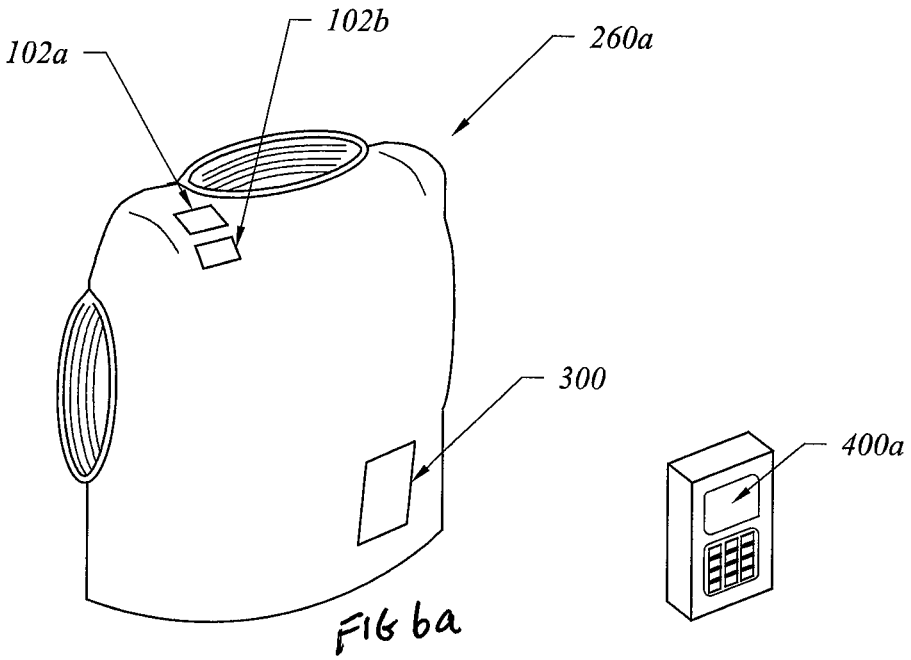
Figure 6B:
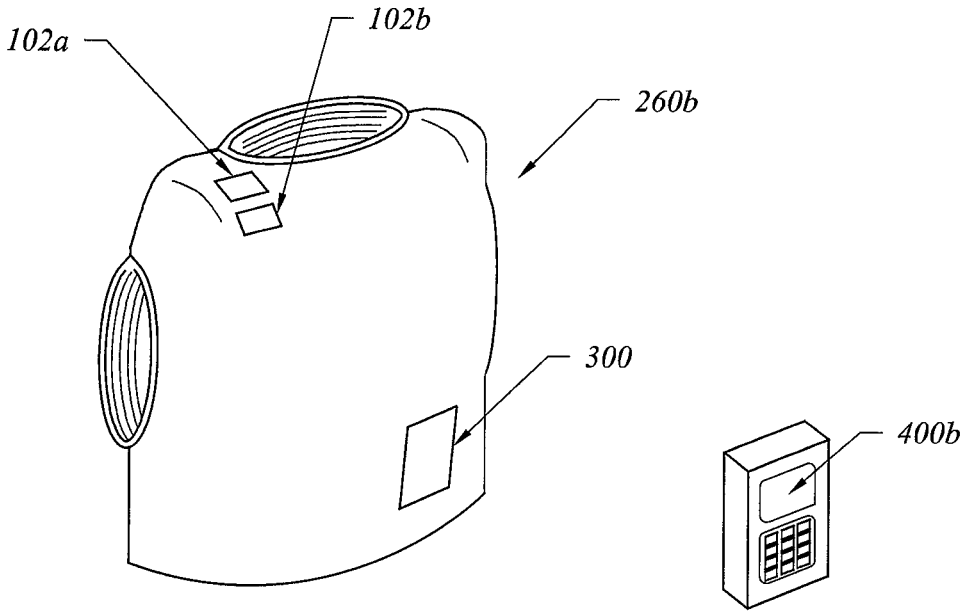

Although the disclosure hereof is detailed to enable those skilled in the art to practice the invention, the embodiments published herein merely exemplify the present invention.

The present invention is a device for deterring a detainee including software controlling the operation thereof. Examples of detainees include but are not limited to arrestees, prisoners, suspects or other agitated individuals. Detainees are further classified by corrections, governmental, law enforcement, medical, military, private security personnel.

The present device deterring movement of a detainee includes a microprocessor, a memory, software controlling the operations of the device, a conductive fabric, at least two electrodes, a rechargeable battery and circuitry for operation of the device deterring movement of a detainee. In operation, the device generates a neuro-peripheral interference that stimulates a portion of the detainee's peripheral nervous system contained in the skin's epidermis and dermis. This stimulation temporarily interferes with the detainee's locomotion. Meeting a long felt but unfilled need, among other things, the present device for deterring a detainee allows the operator to minimize potential injury to an agitated detainee because the device is capable of "taking down" or temporarily distracting the detainee without skin lesions or dermal/muscular injuries associated with prior art devices. By way of illustration, after the detainee's central nervous system detects the neuro-peripheral interference, the neurological signals from the central nervous system and the peripheral nervous system interfere temporarily with muscular locomotion of the detainee. Unless the epidermis of the detainee is contacted by the device deterring movement of a detainee, the detainee does not receive an electric shock.

Preferred embodiments of the device can include a transceiver and one or more transmitters remote from the device deterring movement of a detainee. Manually operated magnetic or radio frequency switches can control activation/deactivation of the microprocessor of the device deterring movement of a detainee. Garments associated with the device deterring movement of a detainee can include, without limitation, bands, gloves and vests. Fabrics associated with the garments can include reusable, cleanable and conductive fabrics where the outer layer of fabric is cut, slash, puncture and fire-resistant. Select preferred fabrics are also capable of activating/deactivating touch sensitive equipment, such as, computing devices including touch sensitive controls.

With reference to FIGS. 1-9, the device deterring movement of a detainee device (100) can be manufactured of a reusable, cleanable and conductive fabric (110) where the outer layer (120) of fabric is cut, slash, puncture and fire-resistant. For example, outer layer (120) can be provided with aramid fibers. Select preferred embodiments of outer layer (120) can include one or more sections (122) capable of activating/deactivating touch sensitive equipment, such as, computing devices that have touch sensitive controls. The device deterring movement of a detainee (100) can be provided with a plurality of electrodes (102*a*), (102*b*), (102*c*), etc. capable of delivering an electrical shock to the detainee's epidermis and dermis.

Single piece housing (300*a*, 300*b*, 300*c*, 300*d*, etc. series 300) contains microprocessor (310), memory (320), transceiver component (330), software component (350), rechargeable battery (360) and can be embedded a portion of garment (200, 230, 260) of device deterring movement of a detainee (100), Circuitry (370) interconnecting connecting microprocessor (310), memory (320), transceiver component (330), software component (350), rechargeable battery (360) and the plurality of electrodes (102*a*), (102*b*), (102*c*) associated with garment (200, 230, 260) can be embedded in the single piece housing (300) and garment (200, 230, 260). Among other things, electrodes (102*a*), (102*b*), (102*c*) can be composed of electrically conductive fabrics or other conductive materials. In select preferred embodiments, single piece housing (300) can be embedded into garment (200, 230, 260) including a pocket (290) for containing the single piece housing (300).

Software component (350) and microprocessor (310) communicate with each other. Potting electronics can be used for select embodiments of microprocessor (310) and its related components to, among other things, waterproof the electronics for device deterring movement of a detainee (100).

Software component (350) controls operations of the device deterring movement of the detainee (100) and memory (320) records data regarding activation/deactivation operations of the device deterring movement of the detainee (100). Within the scope of the current invention, data can also be stored in a remote database from memory (320). The stored data can be date, serial number and time stamped according to the time zone in which the device deterring movement of the detainee (100) was activated/deactivated.

Among other things, software component (350) and the microprocessor (310):

i) control the application of an electric shock to a portion of exposed epidermis of the detainee by causing one of the at least two electrodes (102*a*, 102*b*), embedded in the reusable, cleanable and conductive fabric (110), to administer a nonlethal electric shock to the detainee, wherein the nonlethal electric shock: travels only through the detainee's epidermis and dermis; is administered in ranges from about 210-380 volts, 0.5-1.5 amperes, charge levels of 84-125 microcoulombs and pulse durations between 105-115 microseconds; and interferes temporarily with muscular locomotion of the detainee.

ii) pair microprocessor (310) and memory (320) with an operator's video camera such that an event can be recorded.

iii) coordinate a global positioning system tracking with the device deterring movement of a detainee (100).

Microprocessor (310) has duty cycle of from about 32 to about 35 percent. In select preferred embodiments, microprocessor (310) can be activated/deactivated by manually operated magnetic switch (382) or a radio frequency switch component (384) associated with transceiver component (330). An operator of the device deterring movement of a detainee (100) can switch microprocessor (310) to operational in about one second and to a standby or off mode in about three seconds.

0.5-1.5 amperes administered to the detainee induces neuro-peripheral interference by stimulating a portion of the detainee's peripheral nervous system contained in the skin's epidermis and dermis proximate electrodes (102*a*, 102*b*, 102*c*). It has been discovered that when 0.5-1.5 amperes is administered to the detainee for approximately two to three seconds and the current is pulsed at the rate of about 29 to about 31 pulses per second, the locomotion of the detainee is sufficiently disturbed to produce a detainee that is temporarily manageable by one or more operators.

For preferred embodiments of the device deterring movement of a detainee (100), electric current travels via the detainee's epidermis and dermis without an arc between at least two of the plurality of electrodes (102*a*, 102*b*, 102*c*) and fails to penetrate a layer of the detainee's clothing.

Within the scope of the current invention, the device deterring movement of a detainee (100) can be worn by either the detainee or an operator.

The Detainee Garment

The device deterring movement of a detainee (100) can include garments such as bands (200*a*, 200*b*, 200*c*, 200*d*, etc., series 200) and vests (260*a*, 260*b*, etc., series 260). One or more transmitters (400*a*, 400*b*, 400*c*, 400*d*, etc., series 400), remote from the device deterring movement of a detainee (100), can be adapted to transmit a signal to the transceiver component (330), thereby triggering the device deterring movement of a detainee (100) to shock the detainee. Within the scope of the current invention, transmitter (series 400) transmits at a predetermined frequency in the range of 470-510 MHz frequency hopping to a range of 150 meters line of sight to the transceiver (series 400). Transmitter (series 400) is programmed to intercommunicate with transceiver component (330) and software (350).

In preferred embodiments of the device deterring movement of a detainee (100) transmitter (series 400) can be paired with one of a single or a plurality of bands (series 200) or vests (series 260). In a select preferred embodiment, a single band (200*a*) or vest (260*a*) can pair with a single transmitter (400*a*). In other preferred embodiments, multiple bands (series 200) and/or vests (series 260) can pair with multiple transmitters (400*a*, 400*b*, 400*c*, 400*d*). When a plurality of transmitters (400*a*, 400*b*, 400*c*, 400*d*) are utilized, each of the transmitters (series 400) can be programed to control a single band (series 200) or vest (series 260). However, when circumstances eliminate all but one transmitter (400*d*), the program pairs the remaining transmitter with the available plurality of bands (series 200) and/or vests (series 260) and allows a single transmitter (400*d*) to control operation of the remaining plurality of devices deterring movement of a detainee (100).

The Operator Garment

Figure 7:
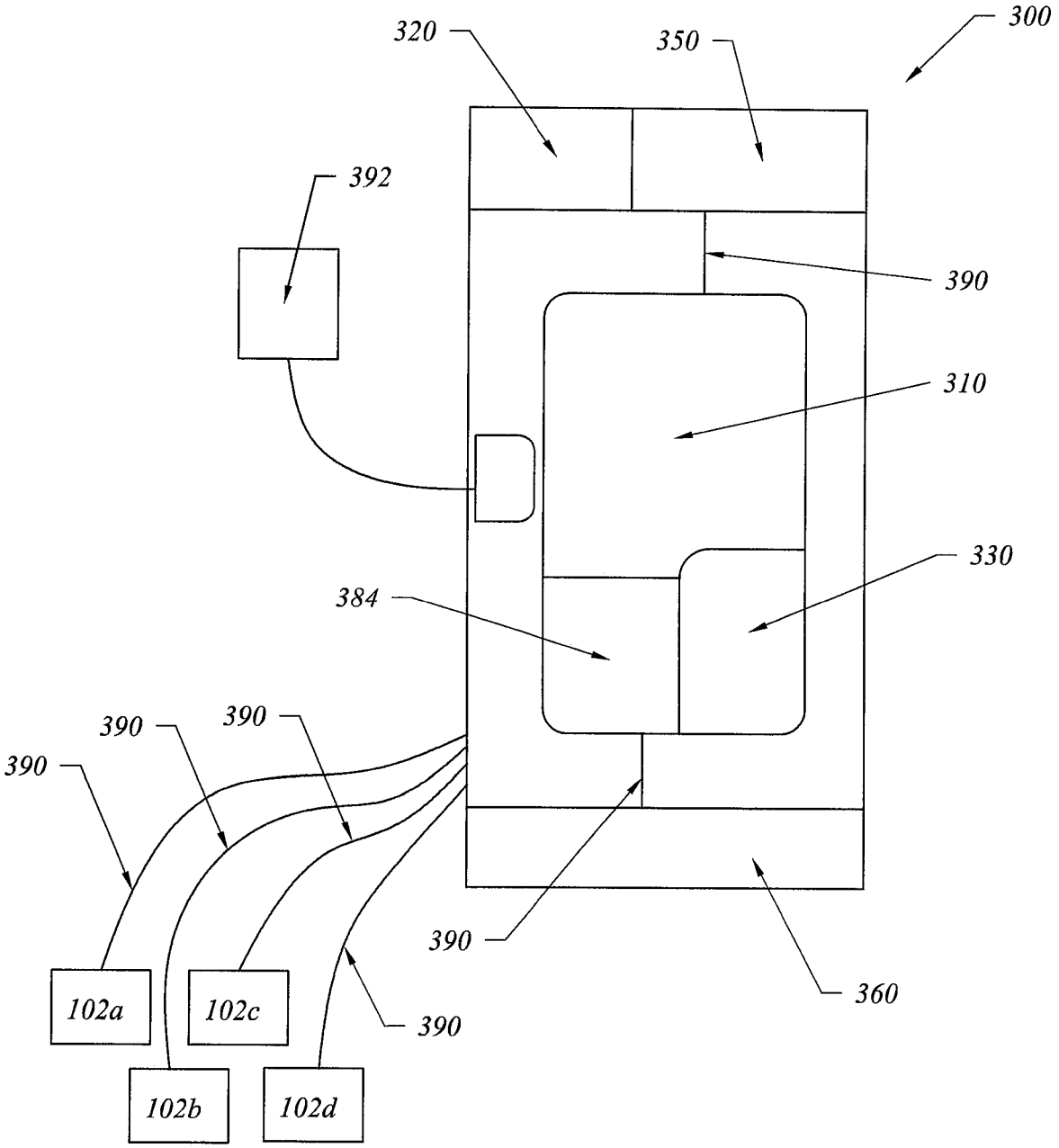
FIG. 7 is a depiction of a second embodiment of single piece housing (300) including microprocessor (310), memory (320) and other components associated with single piece housing (300) of the device deterring movement of a detainee (100).
Figure 8:
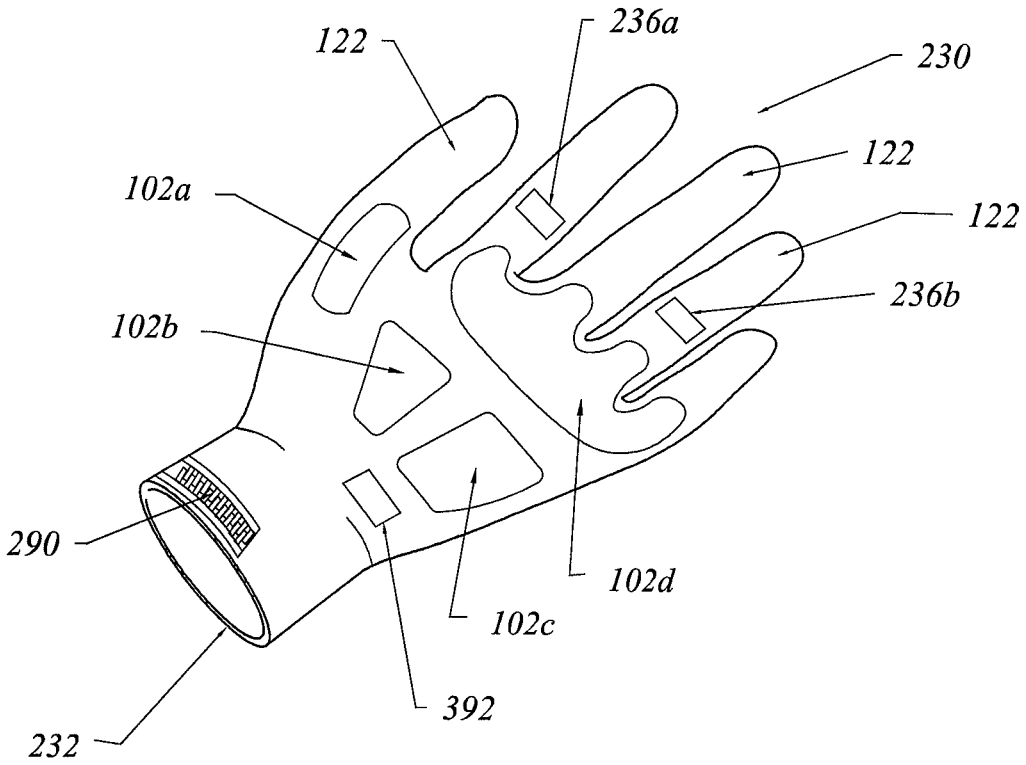
FIG. 8 is a perspective of the palm side of glove (230) of the device deterring movement of a detainee (100).
Figure 9:
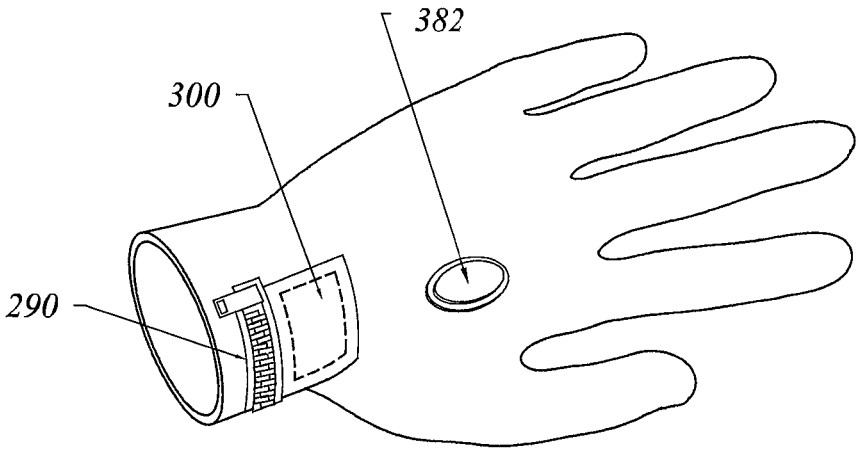
FIG. 9 is a perspective of an outward side of glove (230) of the device deterring movement of a detainee (100).

With reference to FIGS. 7-9, the device deterring movement of a detainee (100) is worn by an operator and can include garments such as gloves (230).

Similar to the device deterring movement of a detainee (100) worn by the detainee, the device deterring movement of a detainee (100) worn by the operator is provided with single piece housing (300) that can be embedded a portion of garment (230). Device deterring movement of a detainee (100) also contains microprocessor (310), memory (320), transceiver component (330), software component (350), haptic generator component (390) and rechargeable battery (360). Circuitry (370) interconnects with microprocessor (310), memory (320), transceiver component (330), software component (350), rechargeable battery (360) and the plurality of electrodes (102*a*, 102*b*, 102*c*, 102*d*), epidermal sensor (236) and haptic actuator (392) associated with garment. Among other things, electrodes (102*a*, 102*b*, 102*c*, 102*d*, etc., series 100) can be composed of electrically conductive fabrics or other conductive materials. In select preferred embodiments, single piece housing (300) can be embedded into garment (230) including a pocket (290) for containing single piece housing (300).

At least one epidermal sensor (236*a*, 236*b*, etc., series 236) is part of glove (230). Epidermal sensor (series 236) communicates with microprocessor (310) and memory (320) when the skin of detainee is contacted. Select preferred embodiments of glove (230) include a haptic generator component (390) and actuator (392). When glove (230) is activated and contacts detainee's skin, actuator (392) causes the operator to feel a vibration indicating activated glove (230) has contacted detainee's skin.

Glove (230) can be provided with housing (300) that can include haptic generator component (390) and haptic actuator (392).

Preferred embodiments of glove (230) can be provided with a layer of insulation (232).

Applicant has enabled, described and disclosed the invention as required by Title of the United States Code and/or the Articles of the Patent Cooperation Treaty.

What is claimed is:

1. A device deterring movement of a detainee comprising:

a) a microprocessor embedded into a reusable, cleanable and conductive fabric; the microprocessor comprising a transceiver component;

b) a memory in communication with the microprocessor; the memory holding software controlling operations of the device deterring movement of the detainee and data about activation/deactivation of the device deterring movement of the detainee, wherein the software and the microprocessor are adapted to:

i) pair the microprocessor and memory with an operator's video camera such that an event can be recorded; and/or ii) coordinate a global positioning system tracking with the device deterring movement of a detainee; and iii) control an electric shock to a portion of exposed skin of the detainee by causing one of the at least two electrodes, embedded in the reusable, cleanable and conductive fabric, to administer a nonlethal electric shock to the detainee, wherein the nonlethal electric shock:

travels only through the detainee's epidermis and dermis;

is administered in ranges from about 210-380 volts, 0.5-1.5 amperes, charge levels of 84-125 microcoulombs and pulse durations between 105-115 microseconds; and interferes temporarily with muscular locomotion of the detainee;

c) a rechargeable battery embedded into to the reusable, cleanable and conductive fabric; and d) circuitry interconnecting the transceiver component, the microprocessor, the memory, the rechargeable battery and the at least two electrodes.

2. The device deterring movement of a detainee of claim 1, wherein the 0.5-1.5 amperes induces neuro-peripheral interference by stimulating a portion of the detainee's peripheral nervous system contained in the skin's epidermis and dermis proximate the electrodes and the 0.5-1.5 amperes is administered to the detainee for approximately two to three seconds, wherein the current is pulsed at the rate of about 29 to about 31 pulses per second.

3. The device deterring movement of a detainee of claim 2, wherein:

a) the electric current travels via the detainee's epidermis and dermis without an arc between at least two of the plurality of electrodes; and b) the traveling electric current fails to penetrate a layer of the detainee's clothing.

4. The device deterring movement of a detainee of claim 3, wherein the reusable, cleanable and conductive fabric comprises a cut, slash, puncture and fire-resistant outer layer.

5. The device deterring movement of a detainee of claim 4, wherein the microprocessor has a duty cycle of from about 32 to about 35 percent.

6. The device deterring movement of a detainee of claim 5 comprising:

a) a garment worn by the detainee, the garment comprising the reusable, cleanable and conductive fabric; and b) one or more transmitters, remote from the device deterring movement of a detainee, adapted to transmit a signal to the transceiver, thereby triggering the device deterring movement of a detainee, wherein each transmitter transmits at a predetermined frequency in the range of 470-510 MHz frequency hopping to a range of 150 meters line of sight to the transceiver component.

7. The device deterring movement of a detainee of claim 6, wherein a manually operated magnetic switch or a radio frequency switch activates/deactivates the microprocessor.

8. The device deterring movement of a detainee of claim 7, wherein the garment is a vest or a band.

9. The device deterring movement of a detainee of claim 8, wherein each transmitter is paired with one of a plurality of bands or vests allowing individualized control of each detainee.

10. The device deterring movement of a detainee of claim 5 comprising a garment worn by the operator, the garment comprising the reusable, cleanable and conductive fabric.

11. The device deterring movement of a detainee of claim 10, wherein a manually operated magnetic switch or a radio frequency switch activates/deactivates the microprocessor.

12. The device deterring movement of a detainee of claim 11, wherein the microprocessor communicates with a haptic generator component connected with the reusable, cleanable and conductive fabric, the haptic generator component's causing haptic actuator to generate sensations to the operator identifying whether the device deterring movement of the detainee is inactivated, activated or applying the nonlethal electric shock to the detainee.

13. The device deterring movement of a detainee of claim 12, wherein the garment is a glove comprising an epidermal sensor.

14. The device deterring movement of a detainee of claim 13 comprising an insulation layer.

15. A device deterring movement of a detainee comprising:

a) a microprocessor embedded into a reusable, cleanable and conductive fabric; the microprocessor comprising a transceiver component;

b) a memory in communication with the microprocessor; the memory holding software component controlling operations of the device deterring movement of the detainee and data about operations of the device deterring movement of the detainee, wherein the software component and the microprocessor control the application of an electric shock to a portion of exposed epidermis of the detainee by causing one of the at least two electrodes, embedded in the reusable, cleanable and conductive fabric, to administer a nonlethal electric shock to the detainee, wherein the nonlethal electric shock:

i) travels only through the detainee's epidermis and dermis;

ii) is administered in ranges from about 210-380 volts, 0.5-1.5 amperes, charge levels of 84-125 microcoulombs and pulse durations between 105-115 microseconds; and iii) interferes temporarily with muscular locomotion of the detainee;

c) a rechargeable battery embedded into to the reusable, cleanable and conductive fabric; and d) circuitry interconnecting the transceiver component, the microprocessor, the memory, the rechargeable battery and the at least two electrodes.

16. The device deterring movement of a detainee of claim 15, wherein the 0.5-1.5 amperes induces neuro-peripheral interference by stimulating a portion of the detainee's peripheral nervous system contained in the skin's epidermis and dermis proximate the electrodes and the 0.5-1.5 amperes is administered to the detainee for approximately two to three seconds, wherein the current is pulsed at the rate of about 29 to about 31 pulses per second.

17. The device deterring movement of a detainee of claim 16, wherein:

a) the electric current travels via the detainee's epidermis and dermis without an arc between at least two of the plurality of electrodes; and b) the traveling electric current fails to penetrate a layer of the detainee's clothing.

18. The device deterring movement of a detainee of claim 17, wherein the software component and the microprocessor:

a) coordinate a global positioning system tracking with the device deterring movement of a detainee; and b) pair the microprocessor and memory with an operator's video camera such that an event can be recorded.

19. The device deterring movement of a detainee of claim 18, wherein the reusable, cleanable and conductive fabric comprises a cut, slash, puncture and fire-resistant outer layer.

20. The device deterring movement of a detainee of claim 19, wherein the microprocessor has a duty cycle of from about 32 to about 35 percent.

* * * * *